US011043351B2

(12) United States Patent
Behling et al.

(10) Patent No.: US 11,043,351 B2
(45) Date of Patent: Jun. 22, 2021

(54) X-RAY SOURCE AND METHOD FOR MANUFACTURING AN X-RAY SOURCE

(71) Applicant: KONINKLIJKE PHILIPS N.V., Eindhoven (NL)

(72) Inventors: Rolf Karl Otto Behling, Norderstedt (DE); Tobias Schlenk, Hamburg (DE); Thorben Repenning, Moorrege (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/621,402

(22) PCT Filed: Jun. 14, 2018

(86) PCT No.: PCT/EP2018/065790
§ 371 (c)(1),
(2) Date: Dec. 11, 2019

(87) PCT Pub. No.: WO2018/229181
PCT Pub. Date: Dec. 20, 2018

(65) Prior Publication Data

US 2020/0105492 A1 Apr. 2, 2020

(30) Foreign Application Priority Data

Jun. 15, 2017 (EP) ..... 17176243

(51) Int. Cl.
*H01J 35/06* (2006.01)
*H01J 35/10* (2006.01)

(52) U.S. Cl.
CPC ..... *H01J 35/064* (2019.05); *H01J 35/105* (2013.01); *H01J 2235/1204* (2013.01); *H01J 2235/1262* (2013.01)

(58) Field of Classification Search
CPC ..... H01J 35/105; H01J 2235/1205
See application file for complete search history.

(56) References Cited

U.S. PATENT DOCUMENTS 5,515,414 A 5/1996 d'Achard Van Enschut
6,252,937 B1 6/2001 Snyder
(Continued)

FOREIGN PATENT DOCUMENTS

DE 674415 C 4/1939
GB 1272498 A 4/1972
(Continued)

OTHER PUBLICATIONS

PCT International Search Report, International application No. PCT/EP2018/065790, dated Aug. 31, 2018.

*Primary Examiner* — Hugh Maupin
(74) *Attorney, Agent, or Firm* — Larry Liberchuk

(57) ABSTRACT

An X-ray source (10) for generating X-rays (11) is provided. The X-ray source (10) comprises an emitter arrangement (12) for generating electrons or for generating X-rays, at least one feedthrough (38) for supplying electrical power to the emitter arrangement (12), and an insulator (20) configured for isolating an electrical potential of the at least one feedthrough (38) from a ground potential. Therein, the at least one feedthrough (38) extends at least partly through the insulator (20), and at least a part of the insulator (20) is in thermal contact with at least a part of the emitter arrangement (12). Further, the insulator (20) comprises at least one cooling channel (28) formed completely in an interior volume (25) of the insulator (20) and configured to dissipate heat from the emitter arrangement (12), wherein a distance (29) between an outer surface (26) of the insulator (20) and the cooling channel (28) is at least as large as half of a thickness (27) of the cooling channel (20).

14 Claims, 3 Drawing Sheets

(56) References Cited

U.S. PATENT DOCUMENTS

| | | | | |
|---|---|---|---|---|
| 2004/0174956 | A1 | 9/2004 | Chidester | |
| 2005/0031073 | A1* | 2/2005 | Radley | G01N 23/223 378/47 |
| 2010/0111265 | A1 | 5/2010 | Holm | |
| 2016/0020059 | A1 | 1/2016 | Haferl | |
| 2018/0299580 | A1* | 10/2018 | Morton | H01J 35/12 |

FOREIGN PATENT DOCUMENTS

| | | | |
|---|---|---|---|
| JP | 2012003995 | A | 1/2012 |
| JP | 2012004083 | A | 1/2012 |
| WO | WO2008034574 | A2 | 3/2008 |

* cited by examiner

X-RAY SOURCE AND METHOD FOR MANUFACTURING AN X-RAY SOURCE

FIELD OF THE INVENTION

Generally, the invention relates to X-ray imaging. More specifically, the invention relates to an X-ray source for generating X-rays, to an X-ray imaging system comprising such X-ray source and to a method for manufacturing such X-ray source.

BACKGROUND OF THE INVENTION

X-ray sources and/or X-ray tubes are usually driven by a high electrical voltage supplied via an electrical supply to an X-ray generating element and/or to an emitter arrangement of the X-ray source. To isolate these high voltages of the electrical supply from ground potential, usually high voltage insulators are used, which may form an interface between an ambient pressure and a vacuum in a vacuum compartment of the X-ray source, in which the X-ray generating element and/or the emitter arrangement may be arranged.

Components of the X-ray source arranged on the vacuum side of the insulator and/or the X-ray source usually carry and/or comprise heat generating components, such as e.g. the X-ray generating element, components of a cathode and/or components of an anode, which heat generating components may generate heat during operation of the X-ray source.

Moreover, on the ambient side of the insulator and/or the X-ray source elements and/or components of the X-ray source may be present which may be degraded due to the heat generated by the heat generating components during operation of the X-ray source.

US2010/0111265A1 relates to a high-voltage x-ray tube with an inner vacuum chamber in which lie, oriented opposite one another, a cathode held at a negative high voltage during operating conditions and an anode held at a positive high voltage during operating conditions, wherein the anode is affixed to an anode isolation element such that the anode isolation element has a cylindrical form or a form tapering toward the anode and comprises an opening to receive a high-voltage plug and has a conductor structure via which a coolant can be supplied to the anode. This coolant can be, in particular, an insulating oil or another electrically nonconductive liquid. The conductor structure can, for example, be integrated completely into the interior of the anode isolation element but can also be integrated into the surface of the high-voltage plug. In another possible solution, the conductor structure is integrated into an intermediate element which lies between the anode isolation element and the high-voltage plug.

DE674415C relates to insulating high-voltage protective housing for liquid-cooled vacuum, especially X-ray tubes, with a container for the tube and another multiple subdivided container for the liquid coolant.

SUMMARY OF THE INVENTION

There may therefore be a need for an improved X-ray source allowing to efficiently and reliably dissipate and/or purge heat during operation of the X-ray source. It may, thus, be an object of the present invention to provide and improved and compact X-ray source having improved cooling means as well as having an extended lifetime.

The object of the present invention is solved by the subject-matter of the independent claims, wherein further embodiments are incorporated in the dependent claims and the following description.

In an aspect, there is provided an X-ray source as defined in appended claim 1. In another aspect, there is provided an X-ray imaging system as defined in appended claim 13. In another aspect, there is provided a method of manufacturing an X-ray source as defined in appended claim 14.

According to a first example, an X-ray source and/or an X-ray tube for generating X-rays is provided. The X-ray source comprises an emitter arrangement, at least one emitter element and/or at least one emitter for emitting and/or generating electrons or for emitting and/or generating X-rays. The X-ray source further comprises at least one feedthrough for supplying electrical power to the emitter arrangement, and an insulator configured for isolating an electrical potential of the at least one feedthrough from a ground potential. Therein, the at least one feedthrough extends at least partly through the insulator, and at least a part of the insulator is in thermal contact with at least a part of the emitter arrangement. Further, the insulator comprises at least one cooling channel formed, integrated and/or arranged completely and/or entirely in an interior volume of the insulator and configured to dissipate and/or purge heat from the emitter arrangement, wherein a distance between an outer surface and/or a periphery of the insulator and the cooling channel is at least as large as half of a thickness of the cooling channel.

The at least one feedthrough may refer to an electrical supply configured for supplying electrical power to at least a part of the emitter arrangement. Particularly, the at least one feedthrough may refer to at least one conductive pin-like element and/or at least one pin, which may be connected to an external power supply and connected to at least a part of the emitter arrangement. Via and/or by means of the at least one feedthrough high voltage may be supplied to at least a part of the emitter arrangement, wherein high voltage may refer to a voltage above about 1000 Volts. Further, the at least one feedthrough may be configured for controlling a voltage supplied to the emitter arrangement, for controlling a current supplied to the emitter arrangement and/or for conducting other electrical signals, such as e.g. sensor signals.

Generally, the emitter arrangement may refer to a heat generating component and/or a heat source of the X-ray source, wherein at least a part of the emitter arrangement may generate heat during operation of the X-ray source, particularly when electrical power is supplied to the emitter arrangement via the at least one feedthrough. By way of example, the emitter arrangement may comprise e.g. an anode, a cathode, a thermionic cathode, an electron beam gun, a deflection plate, a deflection coil, a rotor drive and/or components of the foregoing.

Moreover, the X-ray source may comprise an enclosure at least partly enclosing the emitter arrangement, wherein the insulator may be arranged on a side of the enclosure, and wherein at least a part of the insulator and the enclosure may form a vacuum compartment, in which the emitter arrangement may be arranged.

Accordingly, the insulator may form an interface between the vacuum comprised in the vacuum compartment and an ambient pressure, an environment, a surrounding and/or further components of the X-ray source arranged outside the vacuum compartment. In other words, the insulator may comprise a vacuum side facing the vacuum compartment and an opposite side, which may be referred to as ambient side of the insulator in the following. As a consequence, heat generated during operation of the X-ray source by the emitter arrangement may primarily be transferred and/or conducted via the insulator, which is at least partly in thermal contact with at least a part of the emitter arrangement, from the emitter arrangement to ambient, to the environment, to the surrounding and/or to further components of the X-ray source. Accordingly, the heat may be transferred and/or conducted to other components of the X-ray source arranged on the ambient side of the insulator, such as components comprising e.g. plastic, silicon and/or other materials, which may be degraded during lifetime of the X-ray source due to thermal stress and/or thermal load.

In conventional X-ray sources, usually cooling means, cooling components and/or cooling structures are arranged on the ambient side of the insulator in order to maintain thermal integrity of components of the X-ray source arranged at the ambient side, such as e.g. plastic, rubber and/or silicone components. Such cooling means in conventional X-ray sources may comprise e.g. a heat pipe, a contact to oil and/or a contact to water, which may be provided and/or arranged at an outer periphery of the insulator. However, these cooling means of conventional X-ray sources may have a rather complex design and may require additional space rendering a construction of conventional X-ray sources bulky. Further, heat may not be dissipated efficiently via such cooling means.

By means of the inventive X-ray source with the insulator, in which the at least one cooling channel is formed, arranged and/or integrated, heat may be dissipated and/or purged from the emitter arrangement in an efficient, reliable and comprehensive manner. This in turn may allow to reliably maintain thermal integrity of other components of the X-ray source arranged at the ambient side of the insulator. Accordingly, a lifetime of these components as well as an overall lifetime of the X-ray source may be increased. Also, by integrating the cooling channel in the insulator, no extra space may be required for further cooling means, which may allow to provide a compact X-ray source.

Therein, the at least one cooling channel may be integrated completely and/or entirely in the interior volume and/or in an inner volume of the insulator. In other words, the cooling channel may be arranged and/or integrated in the insulator, such that the cooling channel is completely surrounded by material of the insulator.

Further, by arranging the cooling channel at a distance between the outer surface of the insulator and the cooling channel, which distance is at least as large as half of a thickness of the cooling channel, it may advantageously be ensured that heat generated by the emitter arrangement and transferred to the insulator may be spread and/or conducted via material of the insulator substantially isotopically around the cooling channel. Therein, the distance between the cooling channel and the outer surface of the insulator may be measured from an outer periphery and/or an outer surface of the cooling channel to the outer surface of the insulator, wherein the outer surface of the cooling channel may face the outer surface of the insulator and/or may be arranged opposite to the outer surface of the insulator. Further, the thickness of the cooling channel may refer to a characteristic dimension and/or a dimension of open space of the cooling channel, particularly a characteristic dimension of a cross-section and/or a cross-sectional area of the cooling channel. Further, the thickness may be measured in direction of the outer surface and/or in direction of an outer periphery of the insulator. By arranging the cooling channel at such distance to the outer surface, it may be ensured that heat is also transferred and/or conducted to a region of the insulator between the outer surface and the cooling channel. This arrangement may further increase a cooling efficiency. It is to be noted that the cooling channel may have an arbitrary shape, such as e.g. a cylindrical, a tube-like, a spiral and/or a helical shape. Further, a cross-section and/or a cross-sectional area of the cooling channel may be arbitrarily shaped, such as e.g. polygon-like, rectangular, round, rounded, triangular, elliptical and/or oval. Also, the cooling channel may be arranged in the insulator such that the distance between the cooling channel and the outer surface is constant or varying along a longitudinal extension direction of the cooling channel. Moreover, the insulator may comprise a plurality of cooling channels, which may be arranged in an arbitrary pattern in the interior volume of the insulator.

According to an embodiment, the distance between the outer surface and the cooling channel is a smallest distance between the outer surface and the cooling channel, wherein the distance is measured parallel to a surface normal vector of the outer surface and/or a surface normal vector of a periphery of the insulator. Therein, the surface normal vector may be directed to an outside of the insulator. Further, the distance may be measured from an outer periphery and/or an outer surface of the cooling channel to the outer surface of the insulator, wherein the outer surface of the cooling channel may face the outer surface of the insulator and/or may be arranged opposite to the outer surface of the insulator. Alternatively, or additionally, the thickness of the cooling channel is measured parallel to the surface normal vector of the outer surface. In other words, the distance of the cooling channel to the outer surface and the thickness of the cooling channel may both be measured in a direction parallel to and/or along the surface normal vector of the outer surface of the insulator. By arranging the cooling channel at this specified distance, a heat transfer to the cooling channel and/or a heat dissipation via the cooling channel may advantageously be increased.

According to an embodiment, a cross-section of the cooling channel is rounded and/or round. Alternatively, or additionally the thickness of the cooling channel is a diameter of the cooling channel. Accordingly, the distance between the cooling channel and the outer surface of the insulator may be at least as large as a radius of the cooling channel.

According to an embodiment, the cooling channel at least partly surrounds the feedthrough along a circumferential direction of the insulator. By way of example, the insulator may be a flat insulator, commonly referred to as pancake insulator, wherein the feedthrough may extend through and/or may be arranged in a center region of the insulator. The feedthrough may at least partly be embedded in the center region of the insulator. Alternatively, or additionally the distance between the outer surface of the insulator and the cooling channel is equidistant along a periphery of the insulator. By arranging the cooling channel such that it at least partly surrounds the feedthrough at a constant distance to the surface of the insulator along the circumferential direction, it may be ensured that the insulator is homogenously and efficiently cooled by the cooling channel.

According to an embodiment, the insulator is cylindrical or conical. The insulator may e.g. be an axisymmetric insulator being symmetric around an axis of symmetry, of the insulator. Alternatively, or additionally the feedthrough extends through the insulator parallel to an axis of symmetry of the insulator.

According to an embodiment, the cooling channel is configured to guide a coolant such that heat from the emitter arrangement is dissipated by means of convection cooling via the coolant. The coolant may be a fluid coolant, such as a liquid and/or gaseous coolant. By way of example, the coolant may comprise oil, water, ester and/or any other suitable fluid coolant, including liquid and/or gaseous coolants. Also, the coolant may be oil based, water based, water-alcohol based, ester based and/or a gas. By means of the coolant, which may be contained in the cooling channel, a transfer and/or heat dissipation may be further increased.

According to an embodiment, the X-ray source further comprises an inlet fluidly coupled to and/or in fluid communication with the cooling channel and configured to supply a coolant to the cooling channel. Alternatively, or additionally, the X-ray source comprises an outlet fluidly coupled to and/or in fluid communication with the cooling channel and configured for purging a coolant from the cooling channel. The coolant may e.g. have pumped by means of a pump device into the inlet and/or purged from the outlet to generate a flow of coolant through the cooling channel. Thereby, a cooling effect may be further enhanced.

According to an embodiment, at least a part of the insulator is manufactured by sintering, gluing and/or three-dimensional (3D) printing. Accordingly, the insulator may be comprised of sub-components, such as e.g. particles and/or granules of insulator material, in the raw stage, which may be joined together during manufacturing, production and/or assembly of the insulator. By employing sintering, gluing and/or 3D printing techniques, the insulator with the integrated cooling channel may be processed and/or manufactured precisely in a single processing step. This in turn may allow to manufacture the insulator and/or the X-ray source in a cost efficient manner.

According to an embodiment the insulator is a single homogenous block of isotropic material, such as ceramics material and/or alumina. By way of example, the insulator may comprise Silicon Carbid (SiC), glass, and/or doped alumina, which may be partly conducting. However, the insulator may comprise any other suitable material, such as e.g. reinforced ceramics materials. By forming the insulator as a single homogenous block of isotropic material, in which the cooling channel may be embedded, a heat transfer rate and/or a thermal conductivity of the insulator may be homogenous, such that heat may be conducted efficiently to the cooling channel and dissipated via the cooling channel.

According to an embodiment the insulator comprises a first side facing the emitter arrangement and a second side opposite to the first side. Therein, the first side may refer to the vacuum side of the insulator and the second side may refer to the ambient side of the insulator. Therein, the insulator comprises a first ceramics material at the first side and a second ceramics material at the second side, wherein the first material and the second material differ from each other in at least one of a chemical composition, a density and an electrical conductivity. Generally, the first and second materials, which may be isotropic materials, may have different electrical characteristics. For instance, an electrical conductivity of the first material may be less than an electrical conductivity of the second material, as an electrical field strength may be higher on and/or near the first side, which may face the vacuum compartment of the X-ray source. Generally, manufacturing the first side and the second side of the insulator from different ceramics materials may allow to produce a cost-efficient insulator, as e.g. expensive ceramics material may only be used for the first side whereas cheaper ceramics material may be used for the second side.

According to an embodiment, at least a part of a surface of the cooling channel is metallized and/or a metal layer may be arranged on at least a part of the surface of the cooling channel. The surface of the cooling channel may refer to an outer surface of the cooling channel or to an inner surface of the cooling channel. By metallizing the surface of the cooling channel a heat transfer and/or a thermal conductivity may be further increased. The surface of the cooling channel may be metallized with a metal material comprising e.g. copper and/or any other material having a comparatively high thermal conductivity. Alternatively, or additionally, the cooling channel is comprised of at least one tube formed in the interior volume of the insulator and/or the cooling channel may be comprised of at least one integrated pipe. Also this configuration may further increase a heat transfer from the insulator to the cooling channel. The pipe may comprise metal, such as copper and/or any other material having a comparatively high thermal conductivity.

According to an embodiment, the emitter arrangement comprises at least a part of at least one of an anode, a cathode, a deflection plate, a deflection coil, and an electron beam gun.

According to an embodiment, the X-ray source further comprises an enclosure at least partly enclosing the emitter arrangement, wherein the insulator is arranged on a side of the enclosure, and wherein at least a part of the insulator and the enclosure form a vacuum compartment, in which the emitter arrangement is arranged.

A second example relates to an X-ray imaging system. The X-ray imaging system comprises an X-ray source for generating X-rays, as described above and in the following, and an X-ray detector for detecting X-rays. X-rays generated by the X-ray source may be emitted e.g. in direction of an object of interest, and X-rays passing through the object of interest may be detected with the X-ray detector to generate an X-ray image of the object of interest. The X-ray imaging system may refer to a projection X-ray imaging system, a cone beam imaging system, a computed tomography (CT) imaging system and/or any other X-ray imaging system. Further, it is to be noted that the inventive X-ray source may also be used in an X-ray radiotherapy system.

It is to be noted that features functions, elements and/or characteristics of the X-ray source, as described above and in the following, may be features, functions, elements and/or characteristics of the X-ray imaging system, as described above and in the following, and vice versa.

A third example relates to a method for manufacturing and/or producing an X-ray source for emitting X-rays. Particularly the method may be a method for manufacturing an X-ray source, as described above and in the following. The X-ray source comprises an emitter arrangement for emitting electrons or X-rays, at least one feedthrough for supplying electrical power to the emitter arrangement, and an insulator configured for isolating an electrical potential of the at least one feedthrough from a ground potential. The method comprises the steps of:

forming at least one cooling channel in an interior volume of the insulator, such that the cooling channel is completely arranged in the interior volume of the insulator; and arranging the insulator on a side of the emitter arrangement, such that at least a part of the insulator is in thermal contact with at least a part of the emitter arrangement;

Therein, the cooling channel is formed at a distance between an outer surface of the insulator and the cooling channel, which distance is at least as large as half of a thickness of the cooling channel.

It is to be noted that features functions, characteristics, elements and/or steps of the method, as described above and in the following, may be features, functions, elements and/or characteristics of the X-ray source and/or of the X-ray imaging system, as described above and in the following, and vice versa. In other words, features, elements, functions, characteristics and/or steps described above and in the following with reference to one aspect of the invention may be features, functions, elements, characteristics and/or steps of any other aspect of the invention.

According to an embodiment, at least a part of the insulator and the cooling channel are formed by three-dimensional printing, sintering and/or gluing.

These and other aspects of the invention will be apparent from and elucidated with reference to the exemplary embodiments described hereinafter.

BRIEF DESCRIPTION OF THE DRAWINGS

The subject-matter of the invention will be explained in more detail in the following with reference to exemplary embodiments which are illustrated in the attached drawings.

In principle, identical and/or similar parts are provided with the same reference symbols in the figures.

DETAILED DESCRIPTION OF EMBODIMENTS

Figure 1:
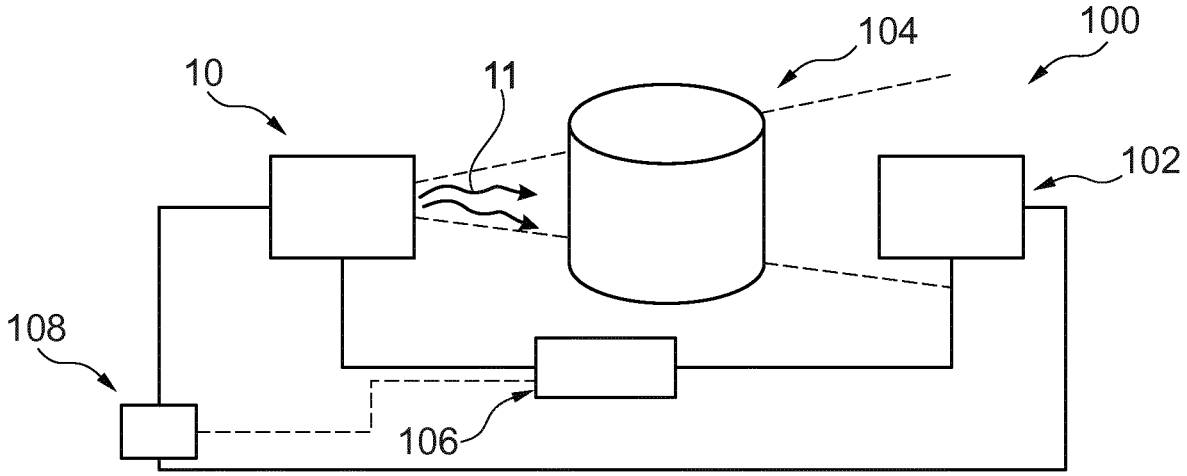
FIG. 1 shows schematically an X-ray imaging system according to exemplary embodiment.

FIG. 1 shows an X-ray imaging system 100 according to exemplary embodiment.

The X-ray imaging system 100 comprises an X-ray source 10 for generating and/or emitting X-rays 11. Further, the X-ray imaging system 100 comprises an X-ray detector 102 for detecting X-rays 11. The X-ray source 10 may emit X-rays 11 in direction of an object of interest 104, which may be e.g. a patient and/or any other object to be examined, and the X-ray detector 102 may detect X-rays 11 passing through and/or traversing the object of interest 104 to generate an X-ray image of at least a part of the object of interest 104.

Further, the X-ray imaging system 100 comprises a controller 106 coupled to the X-ray source 10 and/or to the X-ray detector 102. The controller 106 may be configured for controlling the X-ray source 10 and/or the X-ray detector 102. Also, the controller 106 may be configured to process detector signals of the X-ray detector 102 to generate the X-ray image.

Further, the X-ray imaging system 100 comprises a power supply 108 for supplying electrical power to the X-ray source 10 and/or to the X-ray detector 102. The power supply 108 may be coupled to the controller 106, wherein the controller 106 may be configured to control and/or adjust a power level, such as e.g. a voltage value and/or a current value, supplied to the X-ray source 10.

The X-ray source 10 of FIG. 1 will be explained in more detail with reference to the following figures.

Figure 2A:
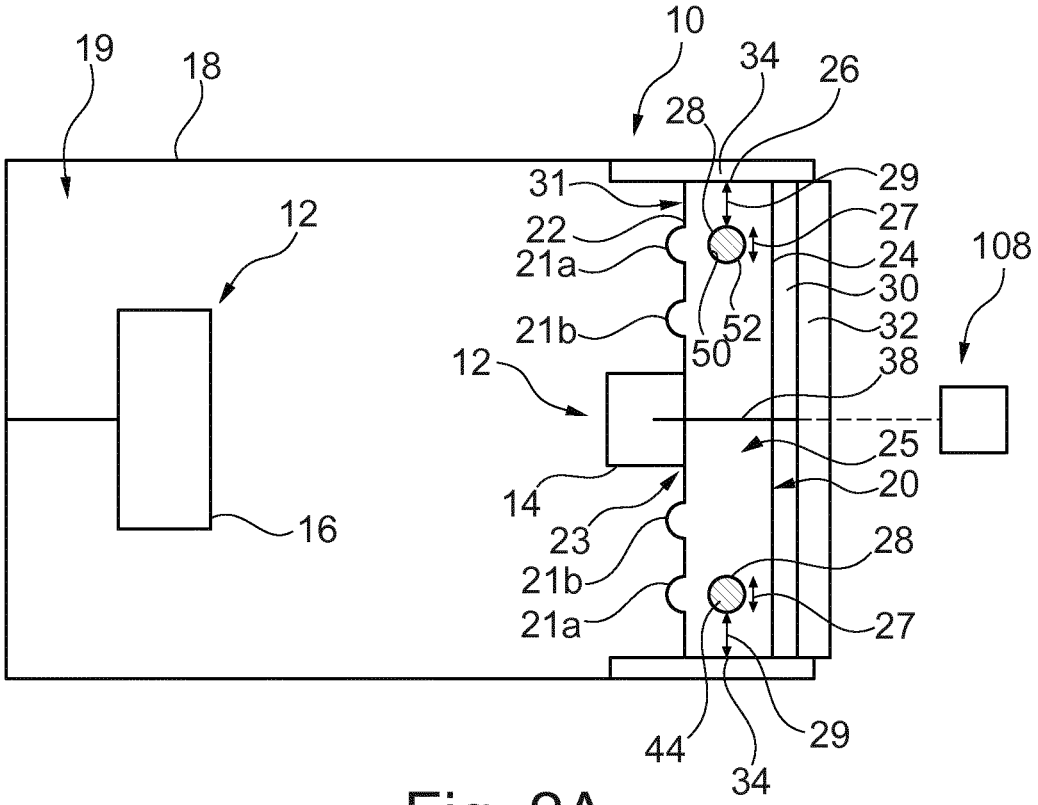
FIG. 2A shows schematically a cross-sectional view of an X-ray source according to an exemplary embodiment.
Figure 2B:
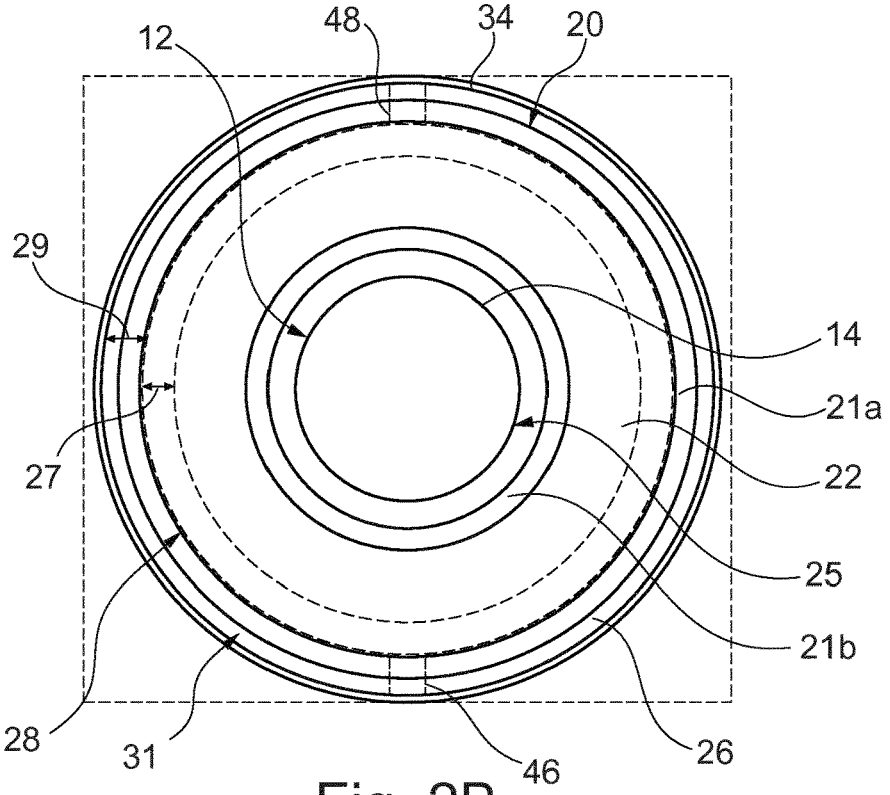
FIG. 2B shows schematically a top view of a part of the X-ray source of FIG. 2A.
Figure 2C:
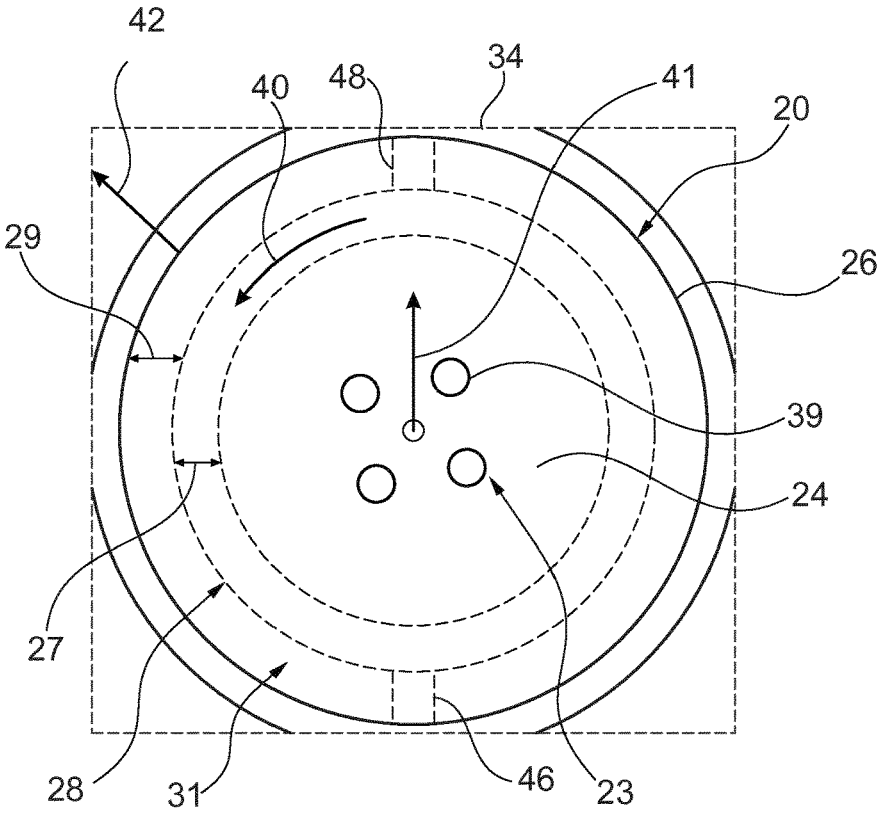
FIG. 2C shows schematically a top view of a part of the X-ray source of FIG. 2A.

FIG. 2A shows schematically a cross-sectional view of an X-ray source 10 according to an exemplary embodiment. FIGS. 2B and 2C each show schematically a top view of a part of the X-ray source 10 of FIG. 2A.

The X-ray source 10 comprises an emitter arrangement 12 for emitting electrons and/or X-rays 11. For this purpose, the emitter arrangement 12 comprises a first emitter element 14 and a second emitter element 16 arranged opposite to the first emitter element 14. The emitter arrangement 12, the first emitter element 14 and/or the second emitter element 16 comprises at least a part of at least one of an anode, a cathode, a deflection plate, a deflection coil, a rotor drive, and an electron beam gun. By way of example the first emitter element 14 may be and/or may comprise a cathode 14 and/or an electron beam gun 14, wherein in this case emitter element 16 may be an anode 16. Electrons emitted by the first emitter element 14 may be accelerated by an acceleration potential between the first emitter element 14 and the second emitter element 16 in direction of the second emitter element 16, wherein X-rays 11 may be generated by electrons impinging onto the second emitter element 16. Alternatively, the first emitter element 14 may be an anode 14 and the second emitter element 16 may be an electron beam gun 16 and/or a cathode 16. Likewise, electrons emitted by the second emitter element 16 may be accelerated by an acceleration potential between the first emitter element 14 and the second emitter element 16 in direction of the first emitter element 14, wherein X-rays 11 may be generated by electrons impinging onto the first emitter element 14.

The X-ray source 10 further comprises an enclosure 18 and an insulator 20 arranged on a side of the enclosure 18. At least a part of the insulator 20 and the enclosure 18 form a vacuum compartment 19, in which the emitter arrangement 12 is arranged.

The insulator 20 comprises a first side 22 facing the vacuum compartment 19, wherein the first side 22 may also be referred to as vacuum side 22. FIG. 2B shows a top view onto the first side 22 of the insulator 20. The insulator 20 further comprises a second side 24 opposite to the first side 14, wherein the second side 24 faces an ambient, a surrounding, an outside and/or an environment of the X-ray source 10. FIG. 2C shows a top view onto the second side 24 of the insulator 20. The second side 24 of the insulator 20 may also be referred to as ambient side 24 of the insulator 20. Accordingly, the insulator 20 may form an interface between the vacuum in the vacuum compartment 19 and an ambient pressure in the surrounding of and/or around the X-ray source 10.

In the example shown in FIGS. 2A-2C, the insulator 20 is cylindrically shaped and/or the insulator 20 is an axisymmetric insulator 20. Such insulators 20 may be referred to as pancake insulators 20 and/or as flat insulators 20. However, the insulator 20 may have any other shape, such as e.g. a conical shape. An axis of symmetry of the insulator 20 illustrated in FIGS. 2A-2C may be arranged substantially perpendicular to the plane of projection of FIGS. 2B and 2C.

The X-ray source 10 further comprises a first insulating element 30 and a second insulating element 32 arranged on the second side of the insulator 20. The first insulating element 30 may e.g. be a silicone slab 30, e.g. a silicone rubber slab 30, and/or the second insulating element 32 may e.g. be a plastic insulator 32. The first insulating element 30 may provide an electrically stable interface. It is to be noted that the X-ray source 10 may comprise further components arranged on the ambient side 24 of the insulator 20.

The insulator 20 is at least partly surrounded, encased and/or encompassed by a metal element 34 and/or a metal ring 34, wherein the metal element 34 may be kept at an electrical ground potential.

The X-ray source 10 further comprises at least one feedthrough 38 extending at least partly through the insulator 20, e.g. through an opening 39 and/or a through hole 39. The at least one feedthrough 38 may be arranged in a center region 23 of the insulator 20 and/or it may be at least partly embedded in the insulator 20. The feedthrough 38 may be a pin-like conductive element 38 and/or a pin 38 coupled to a power supply 108 and coupled to at least a part of the emitter arrangement 12 such that at least a part of the emitter arrangement 12 is supplied with electrical power via the feedthrough 38. The X-ray source 10 may comprise a plurality of feedthroughs 38. As illustrated in FIG. 2C, the X-ray source 10 may comprise four feedthroughs 38 which may be arranged parallel to each other, wherein each feedthrough 38 may be arranged in an opening 39 and/or a through hole 39. The feedthroughs 38 may generally be configured for supplying voltage and/or current to at least a part of the emitter arrangement 12 and/or for conducting sensor signals.

Generally, the insulator 20 is configured for isolating an electrical potential of the at least one feedthrough 38 from ground potential, on which the metal element 34 is kept. Therein, the electrical potential of the feedthrough 38 may be above about 1000 V, particularly above about 100 kV. Accordingly, the insulator 20 may be a high voltage insulator 20, e.g. a high voltage ceramics insulator 20. To sufficiently isolate the feedthrough 38 from the ground potential and/or from the metal element 34, at least one ridge 21*a*, 21*b* and/or rib 21*a*, 21*b* is arranged and/or formed on the first side 22 of the insulator 20. As illustrated in FIGS. 2A and 2B, the insulator 20 comprises a first ridge 21*a* surrounding the feedthrough 38 and/or the center region 23 of the insulator 20 along a circumferential direction 40 of the insulator 20. Further, the insulator 20 comprises a second ridge 21*b* also surrounding the center region 23 and/or the feedthrough 38 along the circumferential direction 40. Accordingly, the first ridge 21*a* and the second ridge 21*b* are arranged concentrically with respect to each other and are spaced apart from each other in a radial direction 41 of the insulator 20. The ridges 21*a*, 21*b* may serve to increase a creep distance between the metal element 34 and the emitter arrangement 12 and/or the first emitter element 14 in order to avoid an electrical flashover and/or spark over. It is to be noted that in case the first emitter element 14 is a cathode 14, the electrical potential of the feedthrough 38 is negative and in case the first emitter element 14 is an anode 14, the electrical potential of the feedthrough 38 may be positive.

The X-ray source 10 and/or the insulator 20 further comprises a cooling channel 28, which is completely and/or entirely integrated, formed and/or arranged in an interior volume 25 and/or an inner volume 25 of the insulator 20, such that the cooling channel 28 is substantially completely surrounded by insulator material of the insulator 20. The cooling channel 28 surrounds the feedthrough 38 and/or the center region 23 of the insulator 20 along the circumferential direction 40. Further, the cooling channel 28 is arranged at a distance 29 to an outer surface 26 and/or an outer periphery 26 of the insulator 20, on which outer surface 26 the metal element 34 is arranged. The distance 29 between the cooling channel 28 and the outer surface 26 of the insulator may be measured from an outer surface of the cooling channel 28 to the outer surface 26 of insulator, which outer surface of the cooling channel 28 may face and/or may be arranged opposite to the outer surface 26 of the insulator 20. Accordingly, the distance 29 may be measured along and/or parallel to the radial direction 41 of the insulator 20. Accordingly, the distance 29 may be a radial distance 29. Alternatively, or additionally, the distance 29 may be measured parallel and/or along a surface normal vector 42 of the insulator 20, wherein the surface normal vector 42 may be parallel to the radial direction 41 of the insulator 20 in the example illustrated in FIGS. 2A-2C. The distance 29 may be a smallest distance 29 between the outer surface 26 and the cooling channel 28 along a periphery of the insulator 20 in circumferential direction 41.

Moreover, the cooling channel 28 has a thickness 27, which may be measured parallel to and/or along the radial direction 41 and/or the surface normal vector 42. Therein, the distance 29 between the outer surface 26 of the insulator 20 and the cooling channel 28 is at least as large as half of the thickness 27 of the cooling channel 28. As at least a part of the insulator 20, particularly the center region 25, is in thermal contact with at least a part of the emitter arrangement 12, particularly the first emitter element 14, heat generated during operation of the X-ray source 10 may be conducted from the emitter arrangement 12 to the center region 23 of the insulator 20 and then spread over substantially the entire inner volume 25 of the insulator 20. As the distance 29 is at least as large as half of the thickness 27 of the cooling channel 28, heat may also be conducted to an outer region 31 of the insulator 20, which outer region 31 is arranged between the outer surface 26 of the insulator 20 and the cooling channel 28. Accordingly, heat may be spread in the interior volume 25 of the insulator 20 such that the heat may be spread and/or distributed around the cooling channel 28. Due to the arrangement of the cooling channel 28 at the distance 29, a cooling efficiency and/or a cooling rate may be significantly increased. Particularly, by arranging the cooling channel 28 in the insulator 20 heat may be dissipated such that a thermal integrity of the further components of the X-ray source 10 arranged at the ambient side 24 of the insulator 20, such as e.g. the first insulator elements 30 and/or the second insulator element 32, is maintained. Also, this may increase a lifetime of the X-ray source 10.

The cooling channel 28 may generally have an arbitrarily shaped cross section and/or an arbitrarily shaped cross-sectional area, such as e.g. a polygon-like, a rectangular, a round, a rounded, an oval, a triangular, or an elliptical shape. In the example illustrated in FIGS. 2A-2C the cooling channel 28 has a round shape. Accordingly, the thickness 27 of the cooling channel 28 refers to a diameter 28 of the cooling channel 28 and the distance 29 may be at least as large as half of a radius of the cooling channel 28. However, generally the thickness 27 of the cooling channel 28 may refer to a characteristic dimension of the cooling channel 28 measured along and/or parallel to the radial direction 41 and/or the surface normal vector 42. Accordingly, in case the cross-section of the cooling channel 28 is rectangular, the thickness 27 may refer to an edge length 27 of the cooling channel 28.

In the example shown in FIGS. 2A-2C, the cooling channel 28 surrounds the center region 23 along the circumferential direction 40, wherein the distance 29 between the cooling channel 28 and the outer surface 26 is constant. Accordingly, the first ridge 21*a*, the second ridge 21*b* and the cooling channel 28 may be arranged concentrically with respect to each other. However, the distance 29 may also vary along the circumferential direction 41. By way of example, the cooling channel 28 may be arranged in the outer region 31 of the insulator 20, wherein the cooling channel 28 may at least partly overlap with a region of the insulator 20, in which the first ridge 21*a* is arranged. Alternatively or additionally, the cooling channel 28 may be arranged in a region of the insulator 28 between the first ridge 21*a* and the second ridge 21*b*, wherein the cooling channel 28 may at least partly overlap with the first ridge 21*a* and/or the second ridge 21*b*. Alternatively or additionally, the cooling channel 28 may be arranged between the center region 23 and a region of the insulator 20, in which the second ridge 21*b* is arranged, wherein the cooling channel 28 may also at least partly overlap with the second ridge 21*b*. Further, the cooling channel may also at least partly be arranged in the first ridge 21*a* and/or the second ridge 21*b*. However, it is to be noted that the cooling channel 28 may be arranged at a certain minimum distance to the feedthrough 38 to avoid a flashover and/or spark over via the cooling channel 28.

Optionally, the cooling channel 28 is configured to guide a coolant 44, which may comprise, water, alcohol, ester and/or any other suitable coolant material. To supply coolant 44 to the cooling channel 28, the X-ray source 10 and/or the insulator 20 may comprise an inlet 46 in fluid communication with the cooling channel 28, as illustrated in FIGS. 2B and 2C. To purge coolant 44 from the cooling channel 28 the X-ray source 10 and/or the insulator 20 may also comprise an outlet 48 in fluid communication with the cooling channel 28. The inlet 46 and/or the outlet 48 may be arranged in the outer region 31 of the insulator 20 and may extend parallel or transverse to the radial direction 41 and/or the surface normal vector 42. Further, a pump device (not shown) may be arranged between inlet 46 and outlet 48 to provide a flow of coolant 44 through the cooling channel 28, thereby increasing a cooling rate.

In order to further increase a cooling effect and/or a cooling efficiency, at least a part of a surface 50 of the cooling channel 28 may be metallized, e.g. with copper. The surface 50 of the cooling channel 28 may be an inner surface 50 or an outer surface 50 of the cooling channel 28. Accordingly, the cooling channel 28 may comprise a layer 52 of metal arranged on the surface 50 of the cooling channel 28. Alternatively, or additionally, the cooling channel 28 may be comprised of at least one tube 52 formed in the interior volume 25 of the insulator 20.

Further, at least a part of the insulator 20 may be manufactured by sintering, gluing and/or three-dimensional printing, which may allow to cost-efficiently produce a homogenous insulator 20 conducting heat homogenously in the interior volume 25. The insulator 20 may be a single homogenous block of isotropic material, such as e.g. alumina, SiC, doped alumina, glass, ceramics material and/or any other suitable material. Alternatively, the insulator 20 may comprise a first material, particularly a first ceramics material, on the first side 22 facing the emitter arrangement 12 and a second material, particularly a second ceramics material, on the second side 24 opposite to the first side 22, wherein the first material and the second material may differ from each other in at least one of a chemical composition, a density and an electrical conductivity.

Figure 3:
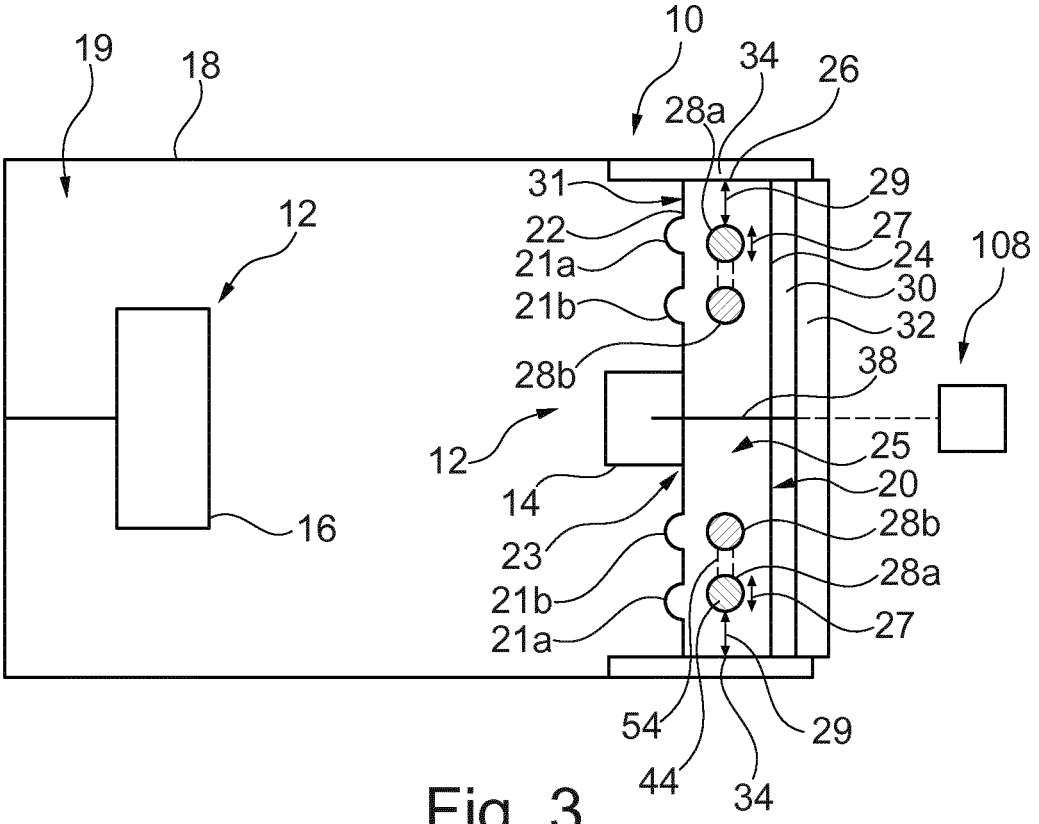
FIG. 3 shows schematically a cross-sectional view of an X-ray source according to an exemplary embodiment.

FIG. 3 shows schematically a cross-sectional view of an X-ray source 10 according to an exemplary embodiment. If not stated otherwise, the X-ray source 10 of FIG. 3 comprises the same features, functions, characteristics and/or elements as the X-ray source 10 described with reference to previous figs, particularly FIGS. 2A-2C.

The Insulator 20 of the X-ray source 10 depicted in FIG. 3 comprises a first cooling channel 28*a* and a second cooling channel 28*b*, which may be arranged concentrically to each other. To allow a coolant 44 to be guided by both cooling channels 28*a*, 28*b*, the cooling channels 28*a*, 28*b* may be interconnected with each other by one or more connecting channels 54, which may extend parallel and/or transverse to the radial direction 41 and/or the surface normal vector 42. Therein, a radial distance between the first cooling channel 28*a* and the second cooling channel 28 may be smaller than a radial distance between the feedthrough 38 and the second cooling channel 28*b* to prevent any flashover. Further, the cooling channels 28*a*, 28*b* may have the same thickness 27 or they may have different thicknesses 27. Particularly, a thickness 27 of the second cooling channel 28*b*, which is arranged closer to the feedthrough 38 than the first cooling channel 28*a*, may be smaller than a thickness 27 of the first cooling channel 28*a* to avoid any flashover. However, the distance 29 between the outer surface 26 and the first cooling channel 28*a*, which is arranged closer to the outer surface 26 than the second cooling channel 28*b*, may in either arrangement be at least as large as the thickness 27 of the first cooling channel 28*a*. Further, it is to be noted that the X-ray source 10 and/or the insulator 20 may also comprise more than two cooling channels 28*a*, 28*b*.

Figure 4:
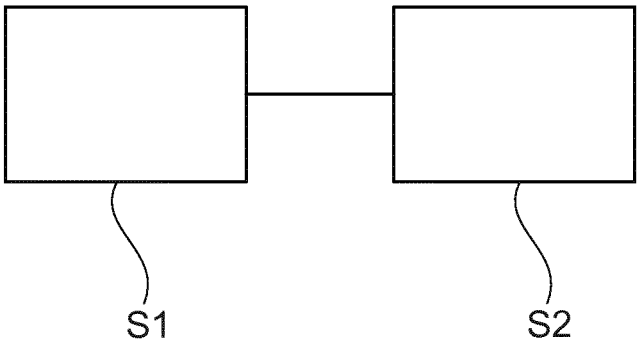
FIG. 4 shows a flow chart illustrating steps of a method for manufacturing an X-ray source according to an exemplary embodiment.

FIG. 4 shows a flow chart illustrating steps of a method for manufacturing an X-ray source 10 according to an exemplary embodiment, wherein the X-ray source 10 may be an X-ray source 10 as described with reference to FIGS. 1-3.

Particularly the X-ray source 10 comprises an emitter arrangement 12 for emitting electrons or X-rays, at least one feedthrough 38 for supplying electrical power to the emitter arrangement 12, and an insulator 20 configured for isolating an electrical potential of the at least one feedthrough 38 from a ground potential.

In a first step S1 at least one cooling channel 28 is formed in an interior volume 25 of the insulator 20, such that the cooling channel 28 is completely arranged in the interior volume 25 of the insulator 20. In step S1, the entire insulator 20 with the cooling channel 28 may be formed in a single process step, e.g. by three-dimensional printing, sintering and/or gluing of insulator sub-components, such as e.g. particles and/or granules of insulator material. Therein, the cooling channel 20 is formed at a distance 29 between an outer surface 26 of the insulator 20 and the cooling channel 28, which distance 29 is at least as large as half of a thickness 27 of the cooling channel 28.

In a second step S2 the insulator 20 is arranged on a side of the emitter arrangement 12, such that at least a part of the insulator 20 is in thermal contact with at least a part of the emitter arrangement 12.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An X-ray source, comprising:

an emitter arrangement for generating X-rays;

at least one feedthrough for supplying electrical power to the emitter arrangement; and an insulator configured to isolate an electrical potential of the at least one feedthrough from a ground potential;

wherein the at least one feedthrough extends at least partly through the insulator;

wherein at least a part of the insulator is in thermal contact with at least a part of the emitter arrangement;

wherein the insulator comprises at least one cooling channel formed completely in an interior volume of the insulator and configured to dissipate heat from the emitter arrangement;

wherein a distance between an outer surface of the insulator and the cooling channel is at least as large as half of a thickness of the cooling channel;

wherein the cooling channel at least partly surrounds the feedthrough along a circumferential direction of the insulator;

wherein the distance between the outer surface of the insulator and the cooling channel is constant along the circumferential direction; and wherein the distance between the cooling channel and the outer surface of the insulator is constant along a longitudinal extension direction of the cooling channel.

2. The X-ray source according to claim 1, wherein the distance between the outer surface and the cooling channel is a smallest distance between the outer surface and the cooling channel measured parallel to a surface normal vector of the outer surface; and wherein the thickness of the cooling channel is measured parallel to the surface normal vector of the outer surface.

3. The X-ray source according to claim 1, wherein a cross-section of the cooling channel is rounded; and/or wherein the thickness of the cooling channel is a diameter of the cooling channel.

4. The X-ray source according to claim 1, wherein the cooling channel is configured to guide a coolant such that heat from the emitter arrangement is dissipated based on convection cooling via the coolant; and/or wherein the cooling channel comprises a fluid coolant.

5. The X-ray source according to claim 1, further comprising:

an inlet fluidly coupled to the cooling channel and configured to supply a coolant to the cooling channel; and/or an outlet fluidly coupled to the cooling channel and configured for purging a coolant from the cooling channel.

6. The X-ray source according to claim 1, wherein at least a part of the insulator is manufactured by sintering, gluing and/or three-dimensional printing.

7. The X-ray source according to claim 1, wherein the insulator is a single homogenous block of isotropic material; and/or wherein the insulator comprises ceramics material and/or alumina.

8. The X-ray source according to claim 1, wherein the insulator comprises a first side facing the emitter arrangement and a second side opposite to the first side;

wherein the insulator comprises a first ceramics material at the first side and a second ceramics material at the second side; and wherein the first material and the second material differ from each other in at least one of a chemical composition, a density and an electrical conductivity.

9. The X-ray source according to claim 1, wherein at least a part of a surface of the cooling channel is metallized; and/or wherein the cooling channel is comprised of at least one tube formed in the interior volume of the insulator.

10. The X-ray source according to claim 1, wherein the emitter arrangement comprises at least a part of at least one of an anode, a cathode, a deflection plate, a deflection coil, a rotor drive, and an electron beam gun.

11. The X-ray source according to claim 1, further comprising:

an enclosure at least partly enclosing the emitter arrangement;

wherein the insulator is arranged on a side of the enclosure; and wherein at least a part of the insulator and the enclosure form a vacuum compartment, in which the emitter arrangement is arranged.

12. An X-ray imaging system, comprising:

an X-ray source, comprising:

an emitter arrangement for generating X-rays;

at least one feedthrough for supplying electrical power to the emitter arrangement; and an insulator configured to isolate an electrical potential of the at least one feedthrough from a ground potential;

wherein the at least one feedthrough extends at least partly through the insulator;

wherein at least a part of the insulator is in thermal contact with at least a part of the emitter arrangement;

wherein the insulator comprises at least one cooling channel formed completely in an interior volume of the insulator and configured to dissipate heat from the emitter arrangement;

wherein a distance between an outer surface of the insulator and the cooling channel is at least as large as half of a thickness of the cooling channel;

wherein the cooling channel at least partly surrounds the feedthrough along a circumferential direction of the insulator;

wherein the distance between the outer surface of the insulator and the cooling channel is constant along the circumferential direction; and wherein the distance between the cooling channel and the outer surface of the insulator is constant along a longitudinal extension direction of the cooling channel; and an X-ray detector for detecting the X-rays.

13. A method for manufacturing an X-ray source, comprising:

providing an emitter arrangement for emitting electrons or X-rays;

providing at least one feedthrough for supplying electrical power to the emitter arrangement;

providing an insulator configured to isolate an electrical potential of the at least one feedthrough from a ground potential;

forming at least one cooling channel in an interior volume of the insulator, such that the cooling channel is completely arranged in the interior volume of the insulator; and arranging the insulator on a side of the emitter arrangement, such that at least a part of the insulator is in thermal contact with at least a part of the emitter arrangement;

wherein the cooling channel is formed at a distance between an outer surface of the insulator and the cooling channel, the distance being at least as large as half of a thickness of the cooling channel;

wherein the cooling channel at least partly surrounds the feedthrough along a circumferential direction of the insulator;

wherein the distance between the outer surface of the insulator and the cooling channel is constant along the circumferential direction; and wherein the distance between the cooling channel and the outer surface of the insulator is constant along a longitudinal extension direction of the cooling channel.

14. The method according to claim 13, wherein at least a part of the insulator and the cooling channel are formed by three-dimensional printing, sintering and/or gluing.

* * * * *